US007571494B2

(12) United States Patent
Grilliot et al.

(10) Patent No.: US 7,571,494 B2
(45) Date of Patent: Aug. 11, 2009

(54) DRAG HARNESS AND POCKET

(75) Inventors: William L. Grilliot, Dayton, OH (US); Mary I. Grilliot, Dayton, OH (US); Douglas Sloan, Douglaston, NY (US); John J. Reilly, Rockville Centre, NY (US); Patricia K. Waters, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 11/788,176

(22) Filed: Apr. 19, 2007

(65) Prior Publication Data

US 2008/0256678 A1 Oct. 23, 2008

(51) Int. Cl.
*A41D 13/00* (2006.01)

(52) U.S. Cl. ..... 2/69; 2/94; 182/3

(58) Field of Classification Search ..... 2/94, 2/108, 247, 253, 93, 81, 85, 102, 227, 250, 2/254

See application file for complete search history.

(56) References Cited

U.S. PATENT DOCUMENTS 1,845,099 A * 2/1932 Popelakova et al. ..... 244/143
2,434,968 A * 1/1948 Smith ..... 128/875
2,568,304 A * 9/1951 Schoenbrun ..... 119/770
3,074,074 A * 1/1963 Lovering ..... 2/94
3,973,643 A * 8/1976 Hutchinson ..... 182/3
3,997,921 A * 12/1976 Knight ..... 2/75
4,384,548 A * 5/1983 Cohn ..... 359/518
4,449,253 A * 5/1984 Hettinger ..... 2/93
4,479,267 A * 10/1984 Radowsky, Jr. ..... 2/337
4,682,671 A * 7/1987 Hengstenberger et al. ..... 182/3
4,706,858 A * 11/1987 Whatley ..... 224/184
4,714,135 A * 12/1987 Bell et al. ..... 182/6
5,351,340 A * 10/1994 Aldridge ..... 2/108
5,450,627 A * 9/1995 Grilliot et al. ..... 2/81
5,542,123 A * 8/1996 DiPietro ..... 2/80
5,544,363 A * 8/1996 McCue et al. ..... 2/102
5,787,529 A * 8/1998 Landes ..... 5/628
5,970,517 A * 10/1999 Jordan ..... 2/69
6,101,631 A * 8/2000 Ferguson, Jr. ..... 2/94
6,134,713 A * 10/2000 De Rosa et al. ..... 2/94
6,205,584 B1 * 3/2001 Yocco ..... 2/69
6,487,725 B1 * 12/2002 Jordan ..... 2/94
6,502,248 B2 * 1/2003 LeGette et al. ..... 2/209
6,662,372 B2 * 12/2003 Lewis et al. ..... 2/69
2003/0196245 A1 * 10/2003 Schweer ..... 2/94
2004/0112302 A1 * 6/2004 Guynn ..... 119/770
2004/0182644 A1 * 9/2004 Kotarski ..... 182/3
2005/0173188 A1 * 8/2005 Lewis et al. ..... 182/3
2006/0070800 A1 * 4/2006 Lewis et al. ..... 182/3
2006/0113147 A1 * 6/2006 Harris, Jr. ..... 182/3

(Continued)

*Primary Examiner*—Gary L. Welch
*Assistant Examiner*—Richale L Quinn
(74) *Attorney, Agent, or Firm*—Wood, Phillips, Katz, Clark & Mortimer

(57) ABSTRACT

A drag harness for use with a protective garment for a fire fighter or emergency worker is provided. The drag harness includes a gripping loop having a pull strap affixed thereto. The pull strap extends from an aperture in the protective garment such that the drag loop can be pulled through the aperture to drag the wearer. Furthermore, the protective garment may include a pocket wherein a portion of the drag loop may be contained when in a stored state.

10 Claims, 3 Drawing Sheets

U.S. PATENT DOCUMENTS

2007/0044197 A1* 3/2007 Turcotte et al. ..... 2/69
2007/0169246 A1* 7/2007 Sloan et al. ..... 2/81
2007/0199135 A1* 8/2007 Grilliot et al. ..... 2/311

* cited by examiner

DRAG HARNESS AND POCKET

FIELD OF THE INVENTION

This invention pertains to a protective garment such as for a fire fighter or emergency worker, and in more particular applications, to a protective garment having including a drag harness.

BACKGROUND OF THE INVENTION

Commonly, a firefighter or an emergency worker wears a protective garment, such as a protective coat. Furthermore, firefighters or emergency workers also wear additional safety equipment, such as drag harnesses, such that the wearer can be dragged and/or carried by a rescuer should the wearer become incapacitated. These drag harnesses can be worn within or on the exterior of the of the protective garment.

In the case where the drag harness is worn within the protective garment, the rescuer must reach in the protective garment to grasp the drag harness. This approach can be time consuming as the rescuer must search within the protective garment for the drag harness. Alternatively, a drag loop of the drag harness is permitted to extend from the protective garment. However, in this situation, the drag loop can get caught on external surfaces, such as tree branches and building debris.

In the case where the drag harness is worn on the exterior of the protective garment, any portion of the drag harness can get caught and/or abraded on external surfaces such as tree branches and building debris.

SUMMARY OF THE INVENTION

In one form, a protective garment for a firefighter or emergency worker is provided. The protective garment includes an outer shell, a pocket and a drag harness. The pocket is affixed to the protective garment and includes a mouth. The drag harness includes at least one wearer loop located within the outer shell adapted to receive a portion of a wearer's body. The drag harness further includes a gripping loop whereby a rescuer can drag the wearer. A portion of the gripping loop is located within the pocket in a stored state and is extended through the mouth of the pocket and away from the outer shell when in a deployed state to drag the wearer.

According to one form, a protective garment for a firefighter or emergency worker is provided. The protective garment includes an outer shell, a pocket and a drag harness. The outer shell includes an interior, an exterior and an aperture providing a passage between the interior and the exterior. The pocket is affixed to the exterior of the protective garment adjacent the aperture includes a releasable closure. The drag harness includes at least one wearer loop located within the outer shell adapted to receive a portion of a wearer's body. The drag harness further includes a gripping loop extending through the aperture into the pocket whereby a rescuer can drag the wearer. A portion of the gripping loop is located within the pocket when in a stored state and is extended from the outer shell when in a deployed state to drag the wearer.

In one form, a drag harness for use with a protective garment having an outer shell and an aperture located on the outer shell is provided. The drag harness includes a wearer loop, a gripping loop and a pull strap. The wearer loop is adapted to receive a portion of a wearer's body. The gripping loop is connected to the wearer loop whereby a rescuer can drag the wearer. The pull strap is connected to the gripping loop. At least a portion of the pull strap is located externally to the aperture whereby the rescuer can pull the gripping loop from a stored state wherein the gripping loop is not visible to an extended state wherein at least a portion of the gripping loop is visible, to grasp the gripping loop and thereby drag the wearer.

According to one form, the protective garment further includes at least one flap releasably covering substantially all of the mouth of the pocket.

In one form, the flap includes a retaining member to releasably maintain the flap covering substantially all of the mouth of the pocket.

According to one form, the pocket is located on an external surface of the outer shell.

In one form, the protective garment further includes a pull strap connected to the portion of the gripping loop wherein a portion of the pull strap extends from the mouth of the pocket.

According to one form, the portion of the pull strap is releasably secured to an external surface of the outer shell.

In one form, the pull strap includes at least one reflective segment located on the portion of the pull strap.

Other objects, features, and advantages of the invention will become apparent from a review of the entire specification, including the appended claims and drawings.

DETAILED DESCRIPTION OF THE ILLUSTRATED EMBODIMENT

Figure 1:
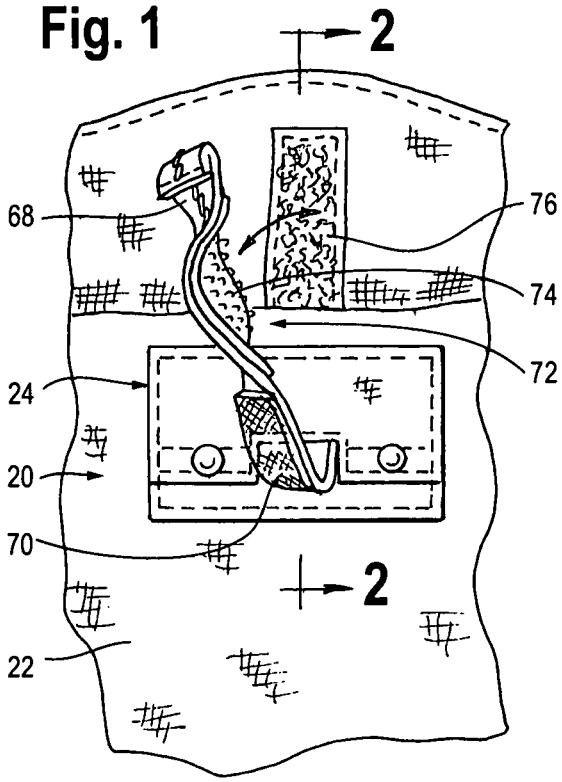
FIG. 1 is a fragmentary view of a protective garment including a pocket and a pull strap for a drag harness.

As illustrated in FIG. 1, a protective garment 20 is shown, such as a jacket. The protective garment 20 has an outer shell 22. Furthermore, it should be understood that the protective garment 20 may include additional components such as internal liners, as understood by those skilled in the art.

Figure 2:
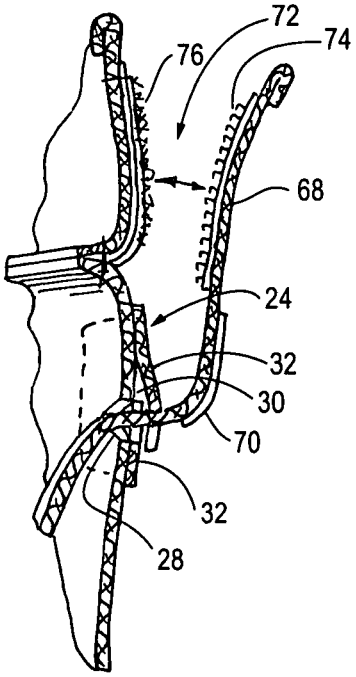
FIG. 2 is a cross-sectional view taken along line 2-2 of FIG. 1.
Figure 5:
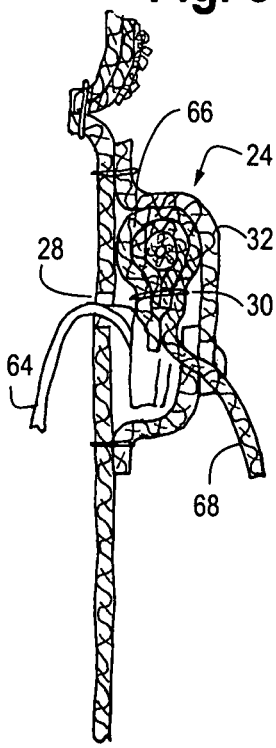
FIG. 5 is a cross-sectional view of another embodiment of a gripping loop located within a pocket.
Figure 6:
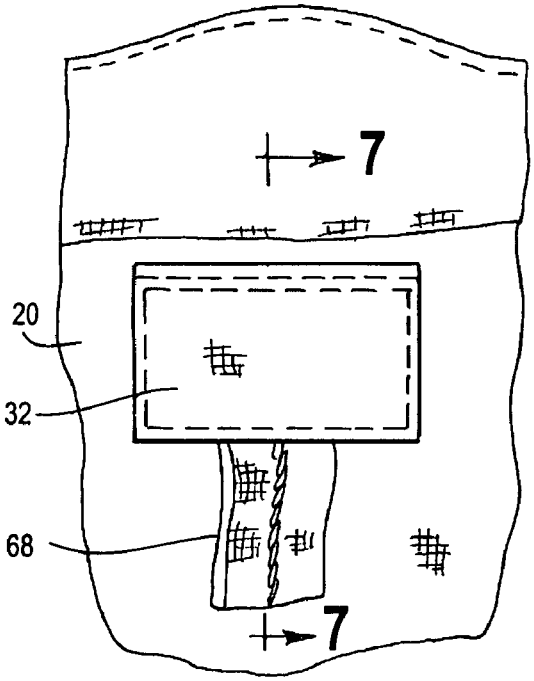
FIG. 6 is a fragmentary view of an aperture and pull strap extending therefrom.

In one form, the protective garment 20 includes a pocket 24 having a mouth 26. In one form, the pocket 24 covers an aperture 28 in the outer shell 22, as shown in FIG. 2, such that the aperture 28 provides access to an interior space 30 of the pocket 24. As shown in FIG. 5, the pocket 24 may also be enlarged such that the interior space 30 has a larger volume. While the pocket 24 is shown on the outer shell 22, it should be understood that the pocket 24 may also be located within the outer shell 22.

Figure 3:
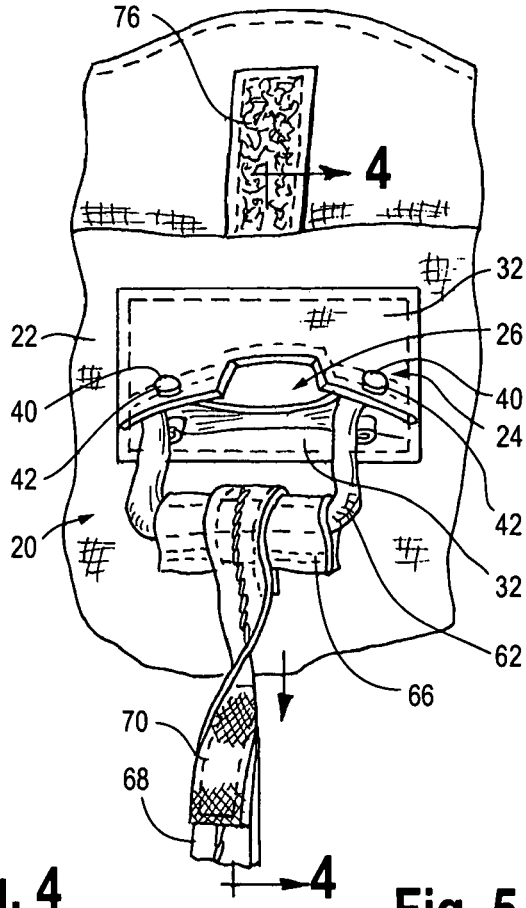
FIG. 3 is a fragmentary view of a pull strap and a gripping loop extending partially from a pocket.
Figure 4:
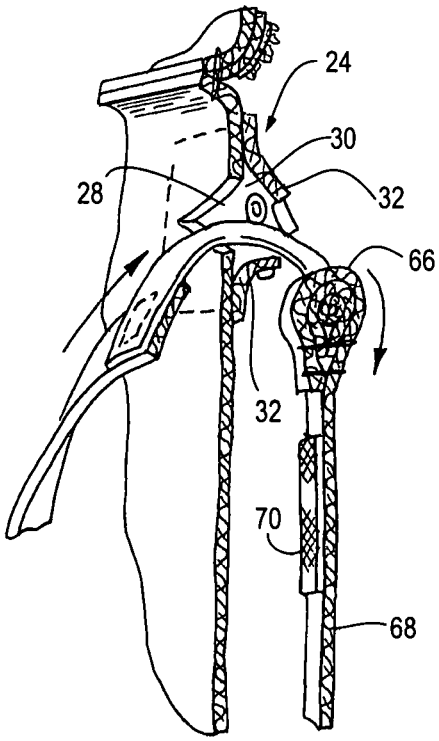
FIG. 4 is a cross-sectional view taken along line 4-4 of FIG. 3.

The pocket 24 further includes at least one closure or flap 32. As illustrated in the embodiments in FIGS. 1-4, the pocket 24 includes two flaps 32. The flaps 32 substantially close the mouth 26 and are releasably secured to one another such that they may be at least partially separated as shown in FIGS. 3-4. It should be understood that the pocket 24 is openable and closable, and when opened, provides access to the interior space 30. The flaps 32 are manually movable between a first position wherein the pocket 24 is open and the mouth 26 is accessible, and a second position wherein the pocket 24 is substantially closed. The flaps 32 can be releasably maintained in the second position via the use of releasable fasteners 40. Specifically, the fasteners 40 in FIGS. 1-4 are snaps 42. It should be understood that other fasteners may also be used, such as hook and loop fasteners, buttons, zippers and the like.

In an alternative form, the protective garment 20 does not include a pocket 24, but instead simply includes the closure or flap 32 covering the aperture 28, as shown in FIGS. 6-9. As shown in this embodiment, there is only a single flap 32. Furthermore, the releasable fasteners 40 include hook 50 and loop 52 fastening elements. In one embodiment, the hook element 50 is located on the flap 32 while the loop element 52 is located directly on the protective garment 20. Other forms of fasteners may also be used, as described above. It should be understood that flaps 32 as illustrated in FIGS. 1-4 could also be used in this embodiment. Similarly, the embodiment illustrated in FIGS. 1-4, as well as the embodiment wherein the pocket is located within the protective garment 20, could utilize the flap 32 as shown in FIGS. 6-9.

Figure 10:
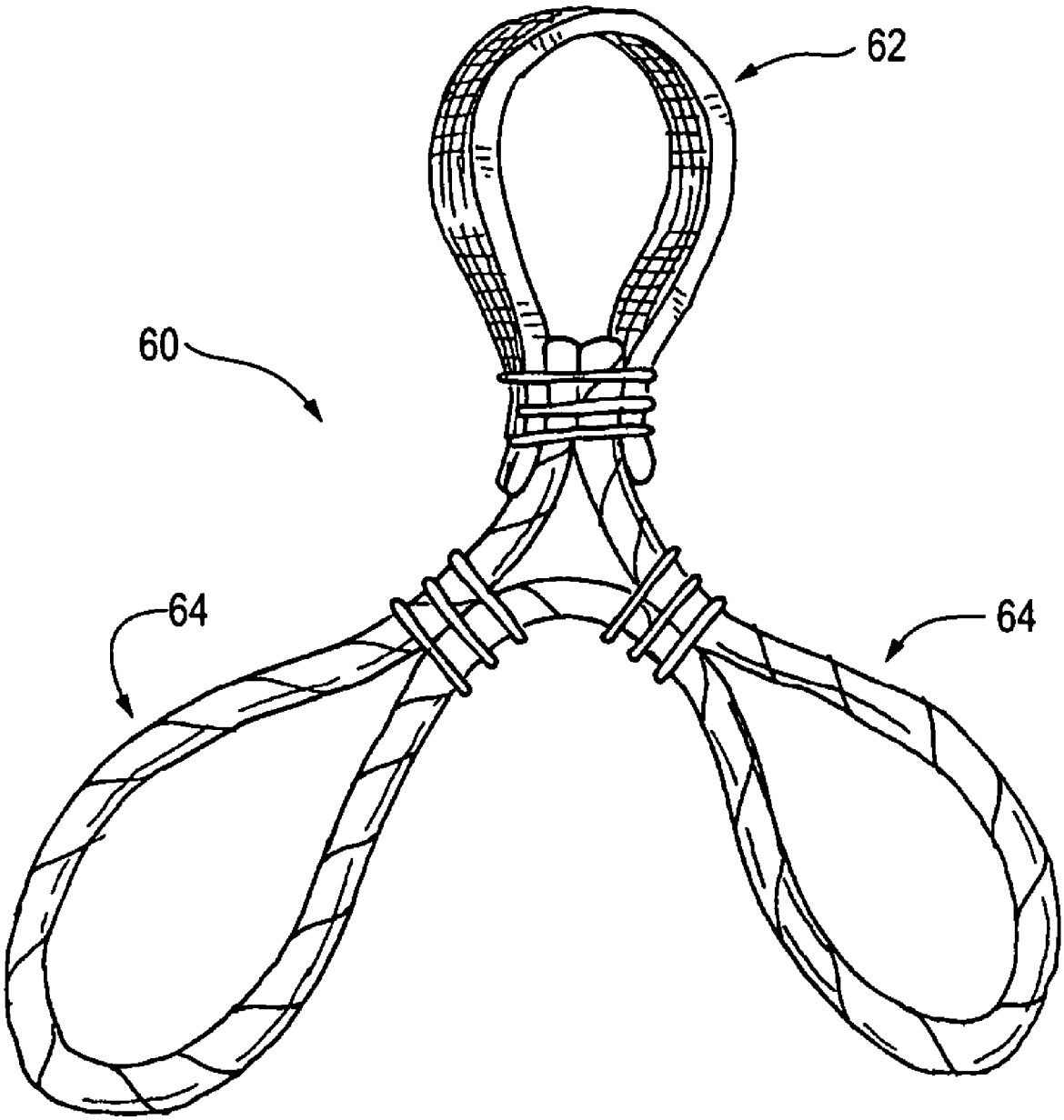
FIG. 10 is a perspective view of one embodiment of a drag harness.

The protective garment 20 further includes a drag harness 60. One form of a drag harness 60 is illustrated in FIG. 10 as having a gripping loop 62 and two wearer's loops 64. In this form, each of the wearer's loops 64 are suitable for being placed around each arm of the wearer. It should be understood that the drag harness 60 may include only one wearer loop 64 such that it would be placed around the torso of the wearer. Additionally, the drag harness 60 may include multiple gripping loops 62. In one form, the wearer loops 64 are made from a single length of strapping or webbing and the gripping loop 62 is attached thereto. In another form, the drag loop 62 and wearer loops 64 are made from a single length of strapping or webbing. In yet another form, each of the wearer loops 64 are made from separate lengths of strapping or webbing. The drag harness 60 may be used whereby a rescuer can grasp the gripping loop 62 to drag and/or carry the wearer. However, it should be understood by those skilled in the art that many forms of drag harnesses may be used.

Figure 8:
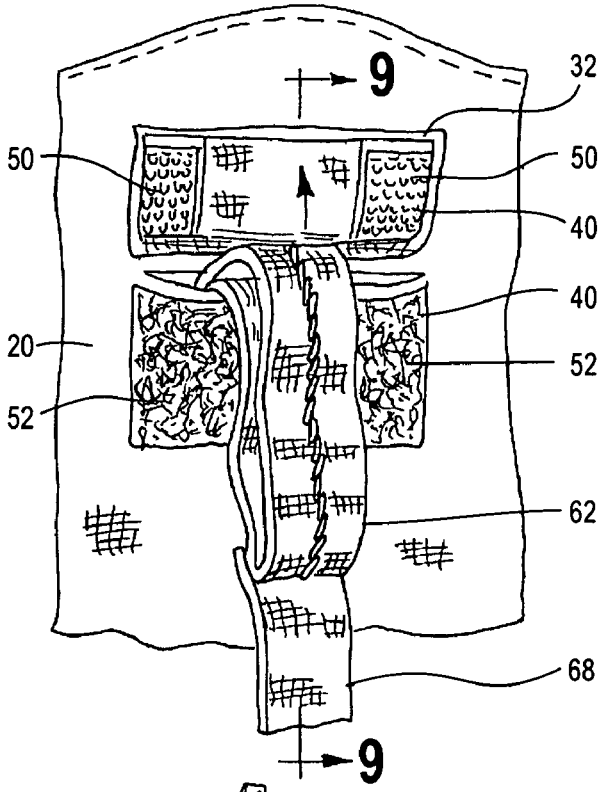
FIG. 8 is a fragmentary view of the aperture and pull strap of FIG. 6 wherein the aperture is in an open position.
Figure 7:
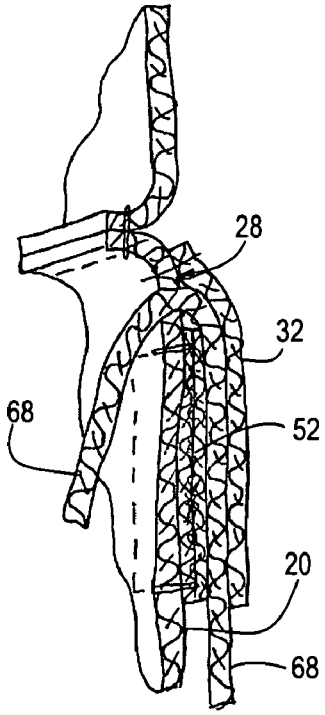
FIG. 7 is a cross-sectional view taken along line 7-7 of FIG. 6.
Figure 9:
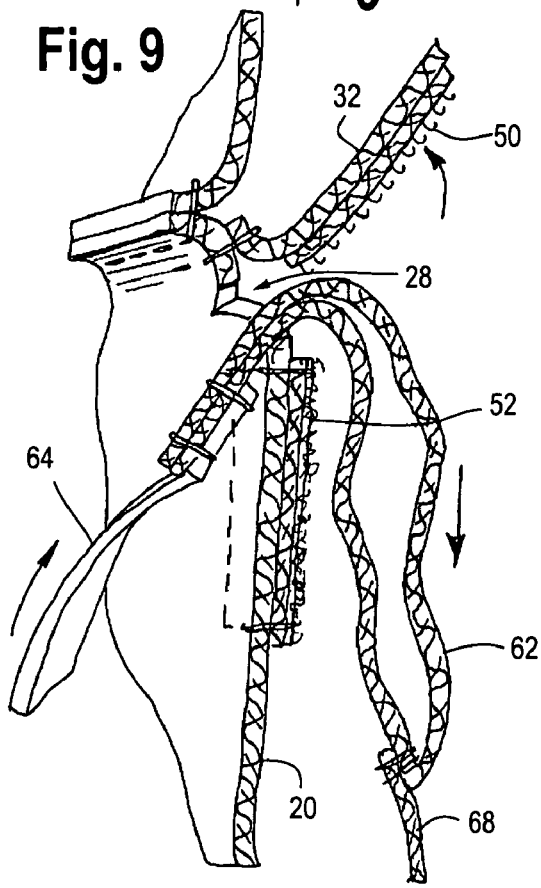
FIG. 9 is a cross-sectional view taken along line 9-9 of FIG. 8.

Referring to FIG. 3, the gripping loop 62 may also include a handle 66 and a pull strap 68. However, it should be understood that the gripping loop 62 may simply include the pull strap 68, as shown in FIG. 8. In a preferred form, the pull strap 68 is made from a single strip of material and/or multiple strips of material affixed to one another along the length of the pull strap 68. The pull strap 68 may include one or more reflective segments 70 to help a rescuer more easily locate the pull strap 68. Furthermore, the reflective segments 70 may also be located on the gripping loop 62.

In one form, the pull strap 68 also includes a retaining member 72 to releasably maintain the pull strap 68 relative to the protective garment 20. As shown in FIGS. 1-3, the retaining member 72 includes hook 74 and loop 76 elements to retain the pull strap 68. As shown in FIG. 1, the pull strap 68 can be maintained having an upward facing orientation such that the reflective segment 70 can be visible. Alternatively, the reflective segment 70 and retaining member 72 may be rotated such that the pull strap 68 has a downwardly facing orientation. It should be understood that the pull strap 68 may be maintained at any desired orientation and/or may be permitted to simply hang, as in FIGS. 6-7.

When the drag harness 60 is in a stored state, at least a portion of the gripping loop 62 can be located either in the interior space 30 and/or inside the protective garment 20 such that the gripping loop 60 is not visible. For example, in the embodiment shown in FIG. 4, the handle 66 is located in the interior space 30 while in FIG. 5, the entire gripping loop 62 is located in the interior space 30. In the embodiment in FIGS. 6-7, the gripping loop 62 is located within the protective garment 20. At least a portion of the pull strap 68 is preferably located on the exterior of the protective garment 20 and/or the pocket 24 in a stored state whereby a rescuer can grasp the pull strap 68 to pull the gripping loop 62 away from the protective garment 20 into a deployed state and drag the wearer. In the deployed state, at least a portion of the gripping loop 60 is visible. The releasable flap(s) 32 permit the gripping loop 62 to be extended from the pocket 24 and/or the protective garment 20.

The pocket 24, drag harness 60 and pull strap 68 may be made from a variety of materials. In one form, the pocket 24, drag harness 60 and pull strap 68 are made from fire resistant material such as Kevlar® and Nomex®. However, it should be understood that a variety of other materials may also be used.

It should be appreciated that for all of the disclosed embodiments there are many possible modifications. Additionally, it should be understood that the embodiments described herein may be utilized in conjunction with one another or separately.

The invention claimed is:

1. A protective garment for a firefighter or emergency worker, the protective garment comprising:

an outer shell;

a pocket affixed to the protective garment, the pocket having a mouth; and a drag harness having at least one wearer loop located within the outer shell adapted to receive a portion of a wearer's body and a gripping loop whereby a rescuer can drag the wearer, wherein a portion of the gripping loop is located within the pocket in a stored state and is extended through the mouth of the pocket and away from the outer shell when in a deployed state to drag the wearer, further comprising a pull strap connected to the portion of the gripping loop wherein a portion of the pull strap extends from the mouth of the pocket with the gripping loop in the stored state.

2. The protective garment of claim 1 further comprising at least one flap releasably covering of the mouth of the pocket.

3. The protective garment of claim 2 wherein the flap includes a retaining member to releasably maintain the flap covering of the mouth of the pocket.

4. The protective garment of claim 1 wherein the pocket is located on an external surface of the outer shell.

5. The protective garment of claim 1 wherein the portion of the pull strap is releasably secured to an external surface of the outer shell.

6. A protective garment for a firefighter or emergency worker, the protective garment comprising:

an outer shell having an interior, an exterior and an aperture providing a passage between the interior and the exterior;

a pocket affixed to the exterior of the protective garment adjacent the aperture, the pocket including a releasable closure; and a drag harness having at least one wearer loon located within the outer shell adapted to receive a portion of a wearer's body and a gripping loop extending through the aperture into the pocket whereby a rescuer can drag the wearer, wherein a portion of the gripping loop is located within the pocket when in a stored state and is extended from the outer shell when in a deployed state to drag the wearer further comprising a pull strap connected to the portion of the gripping loop wherein a portion of the pull strap extends from the mouth of the pocket with the gripping loop in the stored state.

7. The protective garment of claim 6 further comprising at least one flap releasably covering a mouth of the pocket.

8. The protective garment of claim 7 wherein the flap includes a retaining member to releasably maintain the flap covering the mouth of the pocket.

9. The protective garment of claim 6 wherein the portion of the pull strap is releasably secured to an external surface of the outer shell.

10. The drag harness of claim 6 wherein the pull strap includes at least one reflective segment located on the portion of the pull strap.

* * * * *